US009463655B2

(12) United States Patent
Sakai

(10) Patent No.: US 9,463,655 B2
(45) Date of Patent: Oct. 11, 2016

(54) RECORDING DEVICE AND RECORDING METHOD

(71) Applicant: SEIKO EPSON CORPORATION, Tokyo (JP)

(72) Inventor: Hiroaki Sakai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/629,091

(22) Filed: Feb. 23, 2015

(65) Prior Publication Data

US 2015/0239271 A1 Aug. 27, 2015

(30) Foreign Application Priority Data

Feb. 27, 2014 (JP) ..... 2014-036410

(51) Int. Cl.
*B41J 29/393* (2006.01)
*B41J 2/21* (2006.01)
*B41J 2/51* (2006.01)

(52) U.S. Cl.
CPC ..... *B41J 29/393* (2013.01); *B41J 2/2139* (2013.01); *B41J 2/51* (2013.01); *B41J 2/2142* (2013.01); *G03G 2215/00426* (2013.01); *G03G 2215/00556* (2013.01); *G03G 2215/00675* (2013.01)

(58) Field of Classification Search
CPC .. B41J 29/393; B41J 2/17546; B41J 2/0458; B41J 2/0451; B41J 2/2135; B41J 2/2139; B41J 2/51; G03G 2215/00426; G03G 2215/00675; G03G 2215/00556
USPC ..... 347/19
See application file for complete search history.

(56) References Cited

U.S. PATENT DOCUMENTS 5,103,267 A * 4/1992 Wada ..... G03G 15/234 399/20
6,305,858 B1 * 10/2001 Mugrauer ..... B41J 2/01 271/290
2002/0044168 A1 * 4/2002 Hashi ..... B41J 2/16585 347/32
2006/0284906 A1 * 12/2006 Jeong et al. ..... 347/5
2007/0014974 A1 * 1/2007 Vronsky ..... B41J 3/407 428/209
2011/0234721 A1 * 9/2011 Endo ..... G03G 15/6555 347/101

FOREIGN PATENT DOCUMENTS

JP 06-247005 9/1994
JP 09-024627 1/1997
JP 2007-033247 2/2007

* cited by examiner

*Primary Examiner* — Manish S Shah
*Assistant Examiner* — Yaovi M Ameh
(74) *Attorney, Agent, or Firm* — Workman Nydegger

(57) ABSTRACT

A recording device includes: a recording section that records an image on a recording medium; a detecting section that detects an image defect in the image recorded by the recording section; and a repair recording section that is provided separately from the recording section and that performs repair recording for the image defect detected by the detecting section. With such a configuration of the recording device, an image defect in the image recorded on a recording medium is repaired.

5 Claims, 11 Drawing Sheets

RECORDING DEVICE AND RECORDING METHOD

BACKGROUND

1. Technical Field

The present invention relates to a recording device and a recording method.

2. Related Art

Recording devices that record images on recording media have been used. Among these recording devices, a recording device capable of detecting an image defect in an image that has been recorded on a recording medium and repairing the image defect has been disclosed.

For example, JP-A-9-24627 discloses a recording device including a head unit that records on a recording medium and a detecting section capable of detecting an image defect, in which, if the detecting section detects an image defect, the image defect can be repaired by using the head unit.

The recording device disclosed in JP-A-9-24627 is capable of repairing an image defect; however, the recording device is configured to repair the image defect by using the head unit, which records on a recording medium. Accordingly, when an image defect occurs while, for example, the head unit is recording on recording media successively, the recording on the recording media is halted while the head unit is repairing the image defect, whereby the recording efficiency is lowered.

SUMMARY

An advantage of some aspects of the present invention is that an image defect in an image recorded on a recording medium is repaired efficiently.

A recording device according to a first aspect of the invention includes a recording section that records an image on a recording medium, a detecting section that detects an image defect in the image recorded by the recording section, and a repair recording section that is provided separately from the recording section and that performs repair recording for the image defect detected by the detecting section.

According to the first aspect of the invention, the repair recording section, which is provided separately from the recording section and which performs repair recording for the image defect detected by the detecting section, is provided. Therefore, if an image defect occurs when, for example, recording is performed on recording media successively, the recording section can perform recording while the repair recording section is repairing the image defect. That is, an image defect in the image recorded on a recording medium can be repaired efficiently.

It is preferable that the abovementioned aspect of the invention further include a main accumulation section that stores the recording medium on which an image was recorded by the recording section, a first transport section that transports the recording medium to the main accumulation section or the repair recording section on the basis of a detection result of the detecting section, and a second transport section that transports the recording medium, which has been transported to the repair recording section, to the main accumulation section.

In this case, the first transport section transports the recording medium to the main accumulation section or the repair recording section on the basis of the detection result of the detecting section. Therefore, the recording medium can be sorted into the main accumulation section or the repair recording section on the basis of the detection result of the detecting section.

It is also preferable that the abovementioned aspect of the invention further include at least one sub-accumulation section that is provided between the detecting section and the main accumulation section in a transport path of the recording medium and that temporarily stores the recording medium on which an image was recorded by the recording section.

In some cases, it is desired that recording media be stored in the main accumulation section in the order in which images were recorded on the recording media.

According to the abovementioned aspect, the sub-accumulation section, which is provided between the detecting section and the main accumulation section in a transport path of the recording medium and which temporarily stores the recording medium on which an image was recorded by the recording section, is provided. Therefore, in a case where, for example, recording is performed on recording media successively, it becomes possible that a recording medium having no image defect is stored in the sub-accumulation section while the repair recording section is repairing an image defect in the previous recording medium, and then the recording medium stored in the sub-accumulation section is stored in the main accumulation section after the previous recording medium repaired by the repair recording section is stored in the main accumulation section. That is, the recording media can be stored in the main accumulation section in the order in which images were recorded on the recording media.

It is also preferable that the abovementioned aspect of the invention include a plurality of the sub-accumulation sections.

In this case, a plurality of the sub-accumulation sections are provided, whereby the recording media can be stored efficiently in the main accumulation section in the order in which images were recorded on the recording media.

It is preferable that the sub-accumulation sections of the abovementioned aspect of the invention be configured as a first sub-accumulation section that temporarily stores a recording medium on which an image defect is detected by the detecting section, and a second sub-accumulation section that temporarily stores a recording medium on which an image defect is not detected by the detecting section.

In this case, the first sub-accumulation section, which temporarily stores a recording medium on which an image defect is detected by the detecting section, and the second sub-accumulation section, which temporarily stores a recording medium on which an image defect is not detected by the detecting section, are provided as the sub-accumulation sections. Therefore, in a case where, for example, recording is performed on recording media successively, a recording medium having an image defect is temporarily stored in the first sub-accumulation section and a recording medium having no image defect is temporarily stored in the second sub-accumulation section, whereby the recording media can be stored efficiently in the main accumulation section in the order in which images were recorded on the recording media.

It is preferable that the abovementioned aspect include a restoring section for the recording section, the restoring section being configured to be capable of restoring the recording section while the repair recording section is performing repair recording.

In this case, the restoring section is configured to be capable of restoring the recording section while the repair recording section is performing repair recording. Therefore, an image defect in the image recorded on a recording medium can be repaired efficiently.

It is also preferable that the first sub-accumulation section and the second sub-accumulation section of the abovementioned aspect be arranged so as to be shifted in a vertical direction.

In this case, the first sub-accumulation section and the second sub-accumulation section are arranged so as to be shifted in a vertical direction. Therefore, the space in which the recording device is to be installed can be effectively used, and the size of the recording device can be reduced.

A recording method according to a second aspect of the invention includes recording an image on a recording medium by using a recording section, detecting an image defect in the image recorded in the recording, and performing repair recording for the image defect detected in the detecting, by using a repair recording section, which is provided separately from the recording section.

According to the second aspect of the invention, the repair recording section, which is provided separately from the recording section, performs repair recording for the image defect detected in the detecting. Therefore, if an image defect occurs when, for example, recording is performed on recording media successively, the recording section can perform recording even while the repair recording section is repairing the image defect. That is, an image defect in the image recorded on a recording medium can be repaired efficiently.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in detail with reference to the accompanying drawings.

First Embodiment of Recording Device

FIGS. 1 to 4

First, an overview of a recording device according to a first embodiment of the invention will be described.

Figure 1:
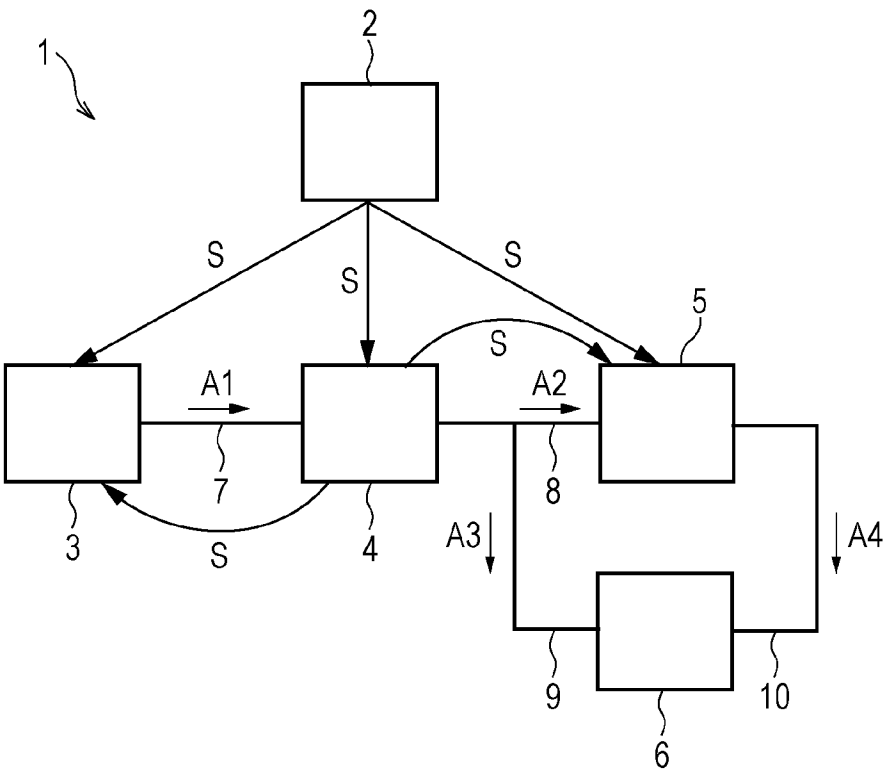
FIG. 1 is a block diagram of a recording device according to a first embodiment of the invention.
Figure 2:
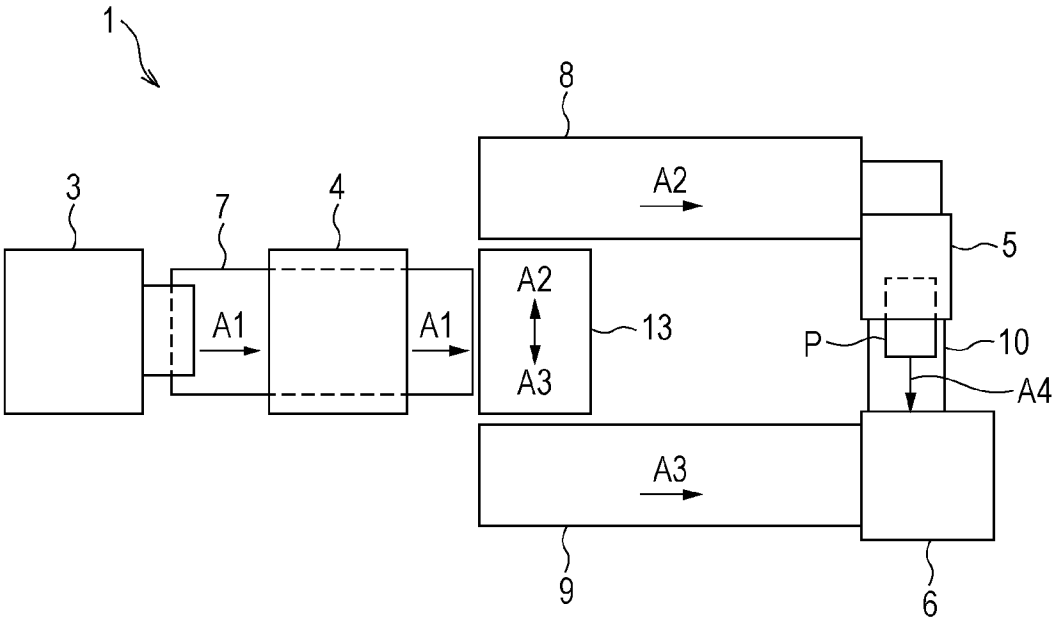
FIG. 2 is a schematic plan view of the recording device according to the first embodiment of the invention.
Figure 3:
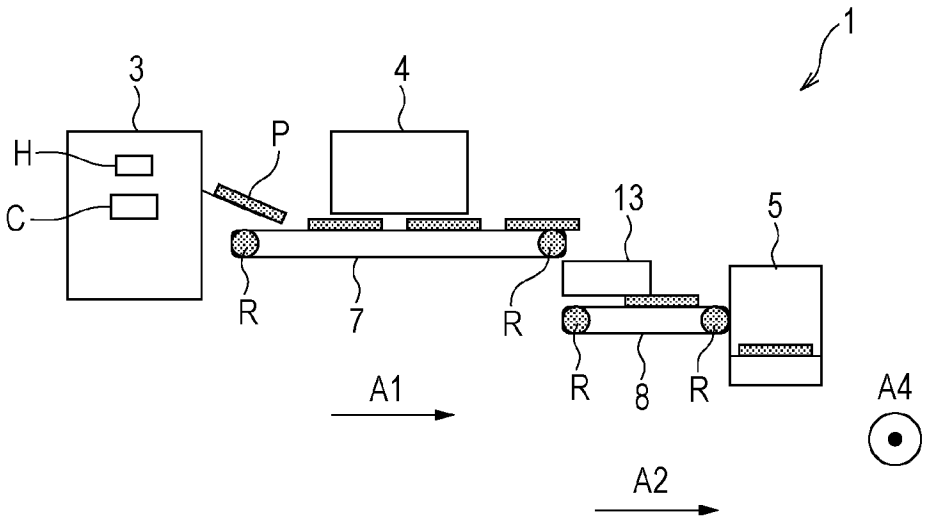
FIG. 3 is a schematic side view of the recording device according to the first embodiment of the invention.
Figure 4:
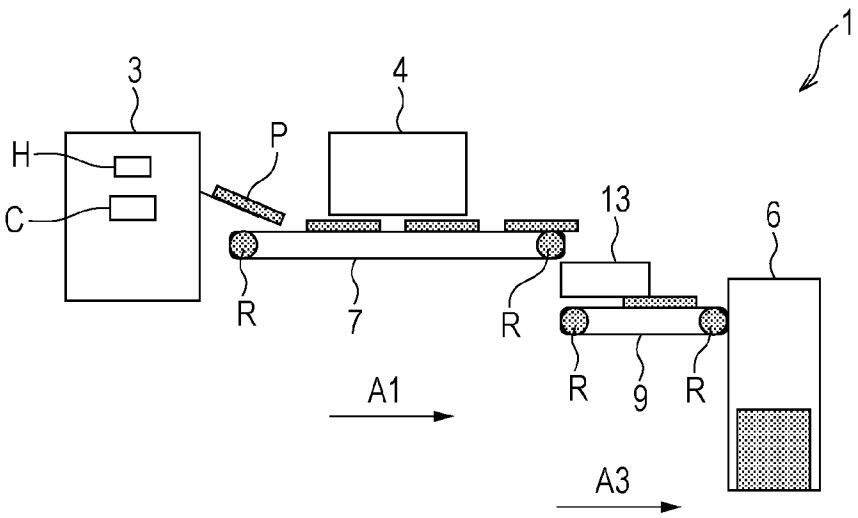
FIG. 4 is another schematic side view of the recording device according to the first embodiment of the invention.

FIG. 1 illustrates a block diagram of a recording device 1 of the present embodiment. In addition, FIG. 2 illustrates a schematic plan view of the recording device 1 of the present embodiment. FIGS. 3 and 4 are schematic side views of the recording device 1 of the present embodiment, respectively showing a side view on the side of a transport section 8 (the side on which a repair recording section 5 is provided), and a side view on the side of a transport section 9 (the side on which the repair recording section 5 is not provided).

The recording device 1 of the present embodiment is a so-called ink jet recording device, in which a recording section 3 includes a recording head H that performs recording by ejecting inks from a plurality of nozzles, and a restoring section C that performs maintenance on the recording head H, but is not limited thereto.

The recording device 1 of the present embodiment includes a recording section 3 that records an image on a recording medium P, a detecting section 4 that detects an image defect in the image recorded by the recording section 3, and a repair recording section 5 that is provided separately from the recording section 3 and that performs repair recording for the image defect detected by the detecting section 4.

With such a configuration, if an image defect occurs when, for example, recording is performed on recording media P successively, the recording section 3 can perform recording while the repair recording section 5 is repairing the image defect. That is, the recording device 1 of the present embodiment is configured so that an image defect in the image recorded on a recording medium P can be repaired efficiently.

Furthermore, the recording device 1 of the present embodiment includes a main accumulation section 6 that stores the recording media P on which images were recorded by the recording section 3.

In addition, the recording device 1 includes a transport section 7 that transports a recording medium P, on which an image has been recorded by the recording section 3, to the detecting section 4. The recording device 1 further includes a sort section 13 that sorts the recording medium P and that determines whether the recording medium P is transported to a transport section 8 or a transport section 9 on the basis of the detection result of the detecting section 4. The transport sections 7, 8 and 9, and the sort section 13 form a first transport section that transports the recording medium P to the main accumulation section 6 or the repair recording section 5 on the basis of the detection result of the detecting section 4. With such a configuration, the recording medium P is sorted into the main accumulation section 6 or the repair recording section 5 on the basis of the detection result of the detecting section 4.

The recording device 1 further includes a transport section 10, as a second transport section that transports the recording medium P, which has been transported to the repair recording section 5, to the main accumulation section 6.

As shown in FIG. 1, the recording device 1 of the present embodiment is electrically connected to a PC 2, and a user is allowed to transmit a signal S, such as an instruction signal and record data, from the PC 2 to the recording section 3, the detecting section 4, and the repair recording section 5.

Moreover, the detecting section 4 and the recording section 3 are electrically connected to each other, and the detecting section 4 and the repair recording section 5 are electrically connected to each other. When detecting an image defect, the detecting section 4 transmits an NG signal, which indicates that an image defect is detected, to the recording section 3 and the repair recording section 5.

When the NG signal is received, the repair recording section 5 performs repair recording on the recording medium P, on which the image defect is detected.

Then, when the recording section 3 receives the NG signal, the restoring section C restores the recording head H by control of a control section (now shown) while the repair recording section 5 is performing repair recording.

With such a configuration, an image defect in the image recorded on a recording medium P is repaired efficiently.

The restoring section C of the present embodiment has a suction section capable of sucking inks from the nozzles that are provided on the recording head H of the recording section 3 and through which inks are ejected, and a wiper capable of wiping a nozzle forming surface of the recording head H. However, the configuration of the restoring section C is not limited thereto.

Furthermore, as shown in FIGS. 3 and 4, each of the transport sections 7, 8 and 9 is formed of an endless belt that is driven by rollers R which can be rotationally driven. Although not shown in the figures, each of the transport section 10 and the sort section 13 is also formed of an endless belt that is driven by rollers R which can be rotationally driven, similarly to the transport sections 7, 8 and 9.

With such a configuration, the transport section 7 is capable of transporting a recording medium P in a direction A1, the transport section 8 is capable of transporting a recording medium P in a direction A2, the transport section 9 is capable of transporting a recording medium P in a direction A3, the transport section 10 is capable of transporting a recording medium P in a direction A4, and the sort section 13 is capable of sorting a recording medium P into the transport section 8 or 9.

Second Embodiment of Recording Device

FIGS. 5 to 8

Next, a second embodiment of a recording device will be described in detail with reference to the accompanying drawings.

Figure 5:
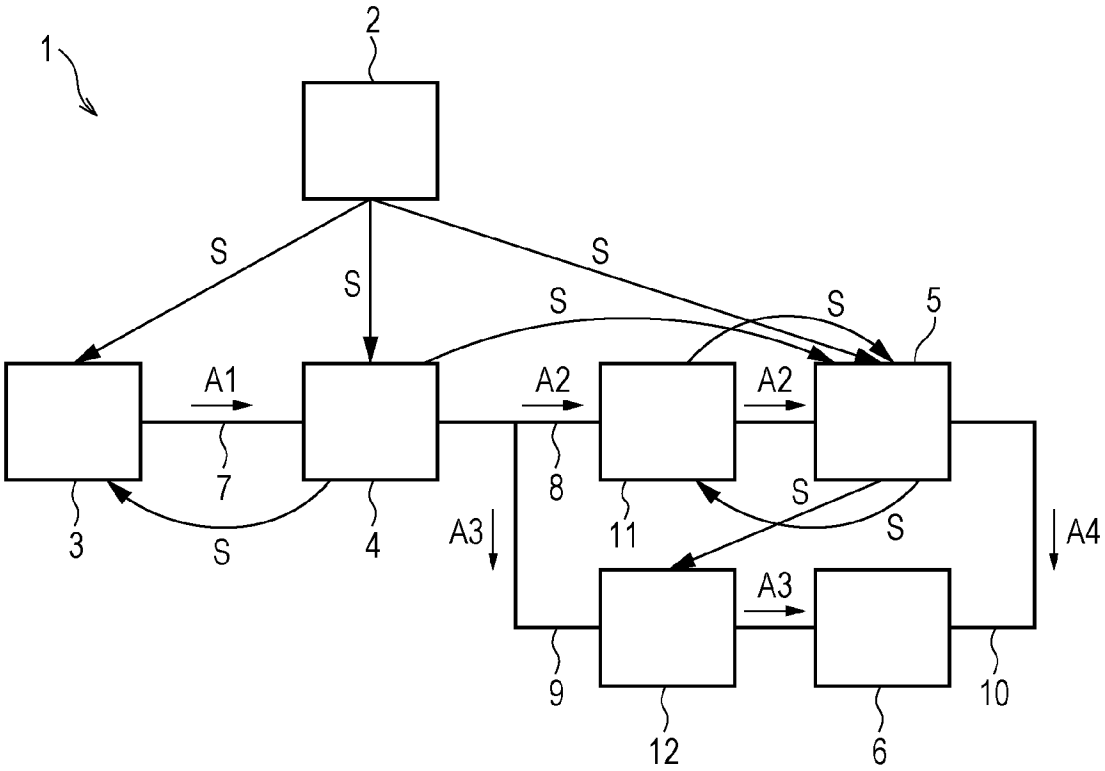
FIG. 5 is a block diagram of a recording device according to a second embodiment of the invention.
Figure 6:
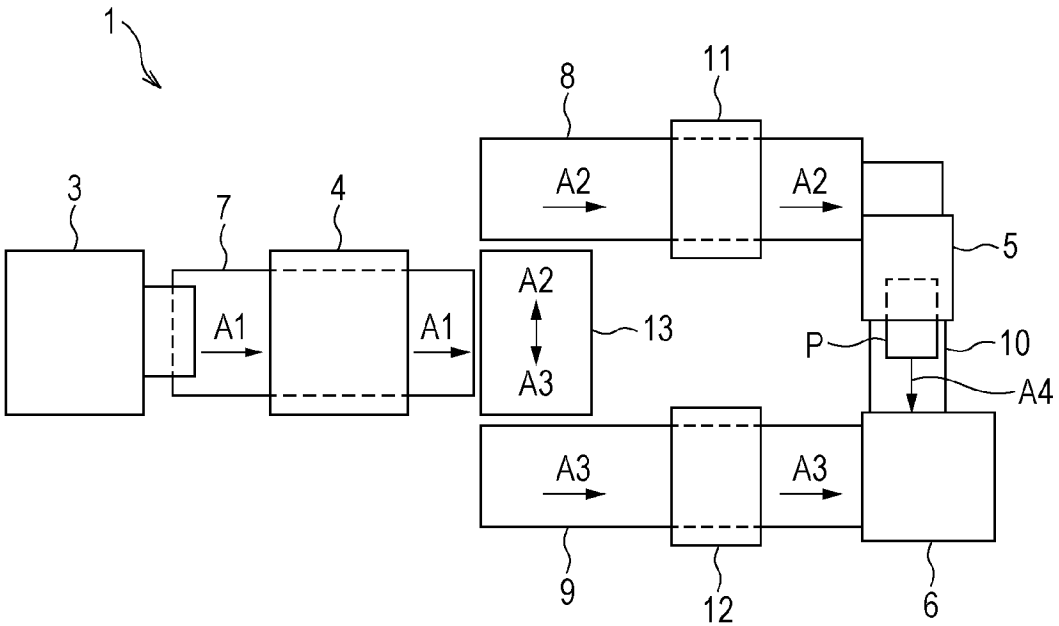
FIG. 6 is a schematic plan view of the recording device according to the second embodiment of the invention.
Figure 7:
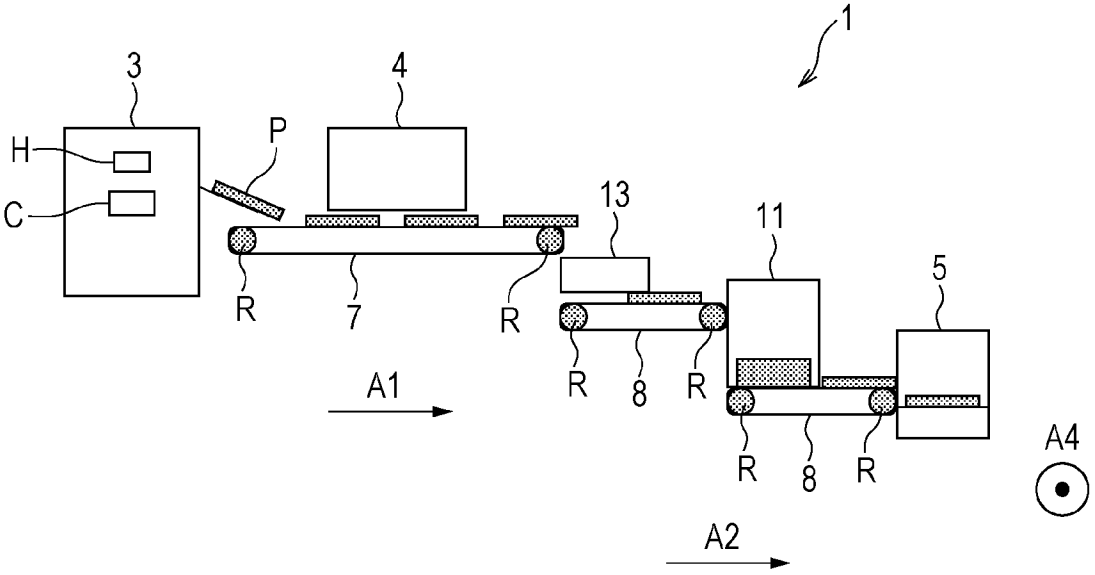
FIG. 7 is a schematic side view of the recording device according to the second embodiment of the invention.
Figure 8:
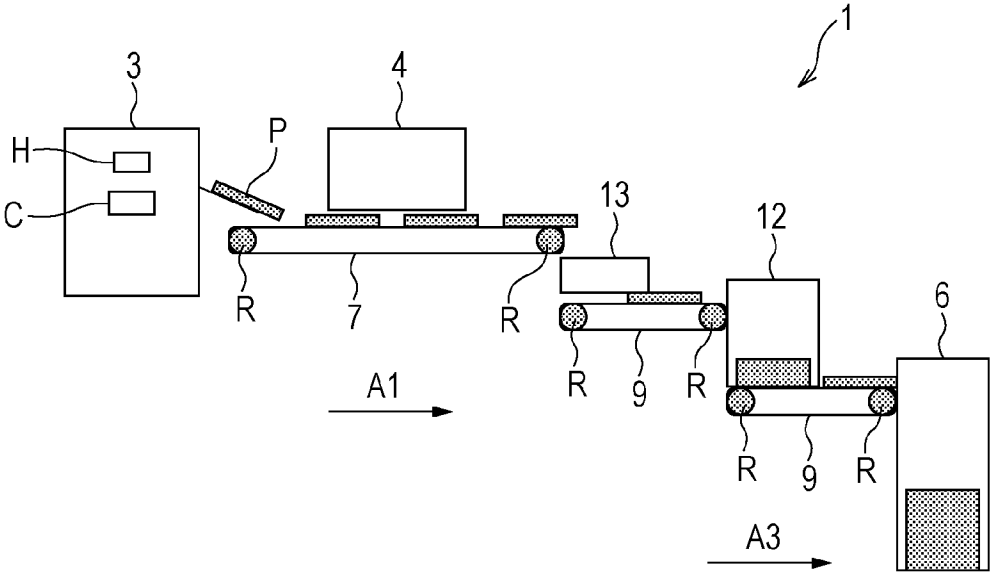
FIG. 8 is another schematic side view of the recording device according to the second embodiment of the invention.

FIG. 5 illustrates a block diagram of a recording device 1 of the present embodiment. FIG. 6 illustrates a schematic plan view of the recording device 1 of the present embodiment. FIGS. 7 and 8 are schematic side views of the recording device 1 of the present embodiment, respectively showing a side view on the side of a transport section 8 (the side on which a repair recording section 5 is provided), and a side view on the side of a transport section 9 (the side on which the repair recording section 5 is not provided). Note that common components in the abovementioned embodiment are denoted with the same reference numerals, and the descriptions of the components are omitted.

In the recording device 1 of the present embodiment, the same configuration as that of the recording device 1 of the first embodiment is used except that a first sub-accumulation section 11 that can temporarily store recording media P up to a specific number is provided on the side of the transport section 8, and a second sub-accumulation section 12 that can temporarily store recording media P up to a specific number is provided on the side of the transport section 9.

As shown in FIGS. 5 to 8, the recording device 1 of the present embodiment includes the first sub-accumulation section 11 and the second sub-accumulation section 12, as sub-accumulation sections, which are provided between the detecting section 4 and the main accumulation section 6 in the respective transport paths of a recording medium P and which temporarily store recording media P on which images were recorded by the recording section 3.

In some cases, it is desired that recording media P be stored in the main accumulation section 6 in the order in which images were recorded on the recording media P. One example is a case where recording media P are enclosed in the respective envelopes, which are prepared separately, in the order in which images were recorded on the recording media P.

As described above, the recording device 1 of the present embodiment includes the sub-accumulation sections, which are provided between the detecting section 4 and the main accumulation section 6 in the respective transport paths of a recording medium P and which temporarily store recording media P on which images were recorded by the recording section 3. Therefore, in a case where, for example, recording is performed on recording media P successively, it becomes possible that a recording medium P having no image defect is stored in a sub-accumulation section while the repair recording section 5 is repairing an image defect in the previous recording medium P, and then the recording medium P stored in the sub-accumulation section is stored in the main accumulation section 6 after the previous recording medium P repaired by the repair recording section 5 is stored in the main accumulation section 6. That is, the recording media P can be stored in the main accumulation section 6 in the order in which images were recorded on the recording media P.

In addition, as shown in FIGS. 5 to 8, the recording device 1 of the present embodiment includes a plurality of the sub-accumulation sections, which are the first sub-accumulation section 11 and the second sub-accumulation section 12, and is therefore capable of efficiently storing recording media P in the main accumulation section 6 in the order in which images were recorded on the recording media P. For example, depending on the size of an image recorded by the recording section 3 and the contents of repair recording performed by the repair recording section 5, the time of recording by the recording section 3 may be shorter than the time of repair recording by the repair recording section 5, and vice versa. Likewise, depending on the recording speed of recording by the recording section 3 and the recording speed of repair recording by the repair recording section 5, the time of recording by the recording section 3 may be shorter than the time of repair recording by the repair recording section 5, and vice versa. Thus, by providing, for example, a sub-accumulation section that stores a recording medium P having no image defect and a sub-accumulation section that stores a recording medium P having an image defect, the recording media P can be efficiently stored in the main accumulation section 6 in the order in which images were recorded on the recording media P.

The first sub-accumulation section 11 is a sub-accumulation section that temporarily stores a recording medium P on which an image defect is detected by the detecting section 4, and the second sub-accumulation section 12 is a sub-accumulation section that temporarily stores a recording medium P on which an image defect is not detected by the detecting section 4.

With such a configuration, in a case where, for example, recording is performed on recording media P successively, the recording device 1 of the present embodiment is capable of efficiently storing the recording media P in the main accumulation section 6 in the order in which images were recorded on the recording media P, by temporarily storing recording media P having image defects in the first sub-accumulation section 11 and temporarily storing recording media P having no image defects in the second sub-accumulation section 12.

The repair recording section 5 and the first sub-accumulation section 11 are electrically connected to each other, and the repair recording section 5 and the second sub-accumulation section 12 are electrically connected to each other. When receiving an NG signal from the detecting section 4, the repair recording section 5 of the present embodiment transmits to the second sub-accumulation section 12 an instruction signal for instructing the second sub-accumulation section 12 to temporarily store recording media P on which image defects are not detected. Then, when receiving a transport instruction (instruction signal) from the repair recording section 5, the second sub-accumulation section 12 transports the recording media P to the main accumulation section 6. Meanwhile, before the repair recording section 5 receives an NG signal from the detecting section 4, the recording media P on which image defects are not detected are stored in the main accumulation section 6 via the second sub-accumulation section 12 without being temporarily stored in the second sub-accumulation section 12.

When receiving an NG signal from the detecting section 4, the repair recording section 5 transmits to the first sub-accumulation section 11 an instruction signal for instructing the first sub-accumulation section 11 to temporarily store recording media P on which image defects are detected. Thus, the recording media P, on which image defects are detected, are transported to the first sub-accumulation section 11 from the detecting section 4. The first sub-accumulation section 11 can count the number of recording media P stored therein, and the count number is transmitted to the repair recording section 5. Meanwhile, when the repair recording section 5 is not performing repair recording, a recording medium P on which an image defect is detected is immediately transported to the repair recording section 5 from the first sub-accumulation section 11, but when the repair recording section 5 is performing repair recording, the recording medium P is transported from the detecting section 4 to the first sub-accumulation section 11 and stored therein.

As shown in FIGS. 7 and 8, each of the first sub-accumulation section 11 and the second sub-accumulation section 12 is configured in such a manner that a recording medium P is inserted from the upper side thereof and is transported from the bottom side thereof. Thus, the recording media P stored in the first accumulation section 11 and those stored in the second accumulation section 12 can be transported to the main accumulation section 6 while the order of recording is maintained.

With such a configuration, the recording device 1 of the present embodiment stores the recording media P, on which recording is performed, in the main accumulation section 6 while preventing the recording media P from being stored therein in an order different from the order in which images were recorded on the recording media P.

Third Embodiment of Recording Device

FIG. 9

Next, a third embodiment of a recording device will be described in detail with reference to the accompanying drawings.

Figure 9:
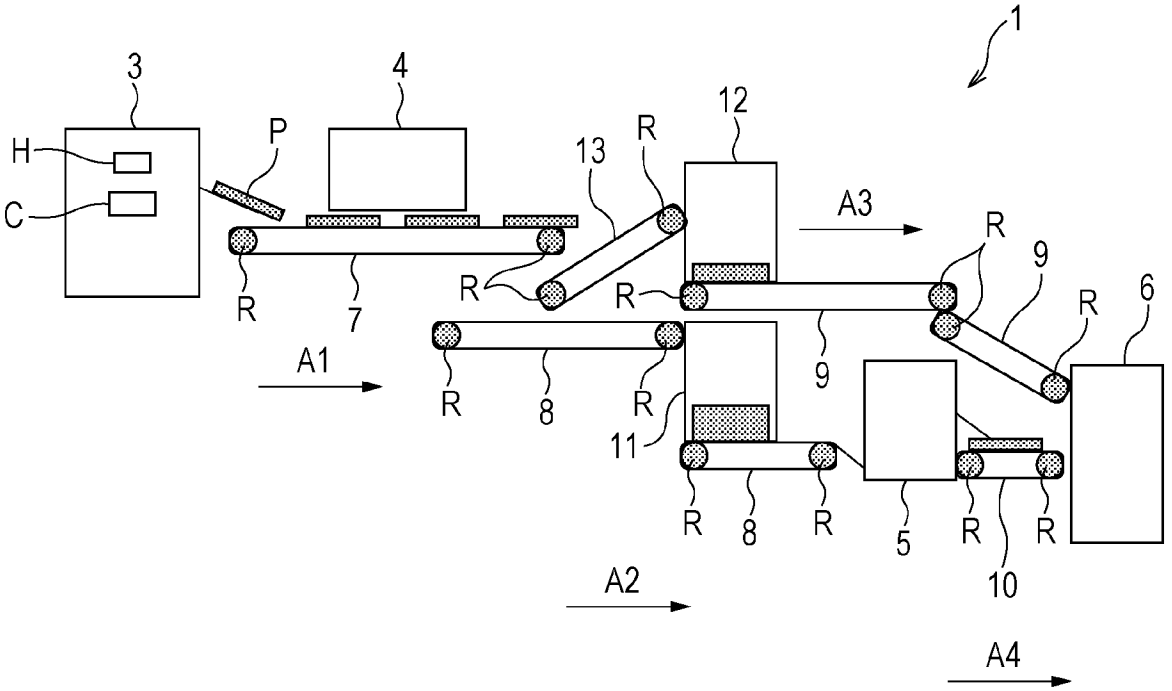
FIG. 9 is a schematic side view of a recording device according to a third embodiment of the invention.

FIG. 9 illustrates a schematic side view of a recording device 1 of the present embodiment. Note that common components in the abovementioned embodiments are denoted with the same reference numerals, and the descriptions of the components are omitted.

Meanwhile, in the recording device 1 of the present embodiment, the same configuration as that of the recording device 1 of the second embodiment is used except that the first sub-accumulation section 11 and the second sub-accumulation section 12 are arranged so as to be shifted in a vertical direction.

As shown in FIG. 9, in the recording device 1 of the present embodiment, the first sub-accumulation section 11 and the second sub-accumulation section 12 are arranged so as to be shifted in a vertical direction. Therefore, the space in which the recording device 1 is installed is effectively used, and the size of the recording device 1 is reduced.

First Embodiment of Recording Method

FIG. 10

Next, a first embodiment of a recording method using the recording device 1 of the abovementioned first embodiment will be explained.

Figure 10:
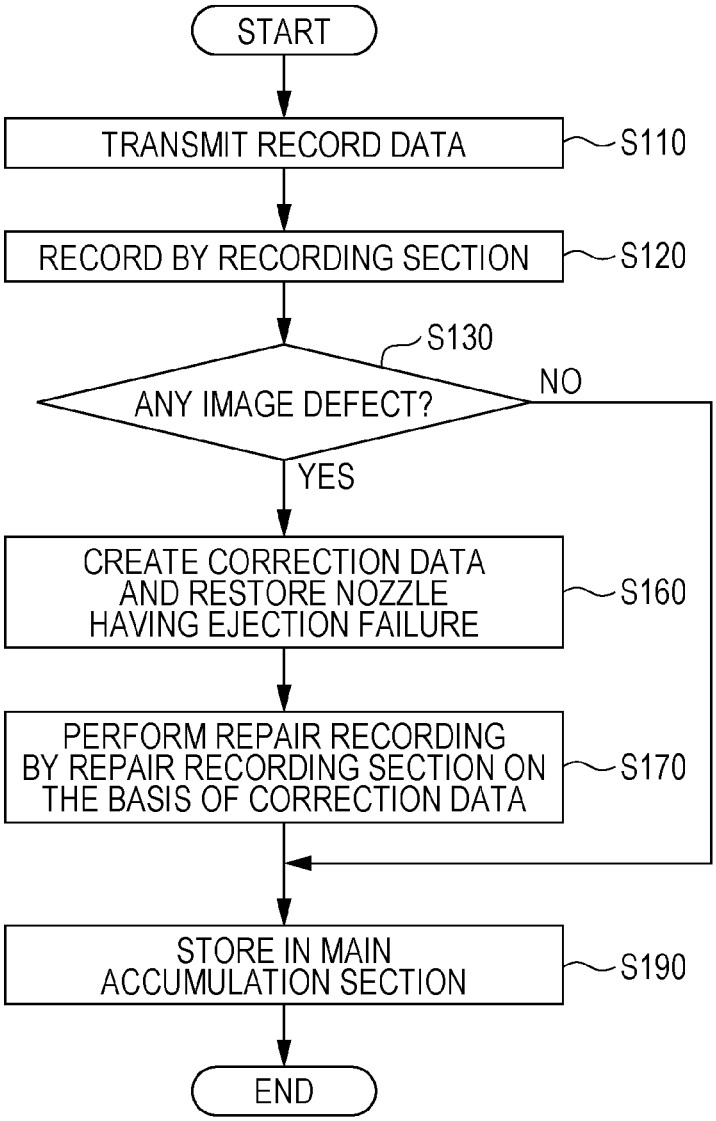
FIG. 10 is a flowchart showing a recording method according to the first embodiment of the invention.

FIG. 10 is a flowchart showing a recording method of the present embodiment, and the recording method corresponds to recording for one recording medium P. Thus, when recording is performed for a plurality of recording media P on the basis of the record data input from the PC 2, the recording method (the recording method for one recording medium P) represented in the flowchart of FIG. 10 is repeated for the number of the recording media P.

In the recording method of the present embodiment, first, in step S110, record data that corresponds to one recording medium P is transmitted to the recording section 3, the detecting section 4, and the repair recording section 5 by multicast.

Next, in step S120, the recording section 3 performs recording based on the record data transmitted in step S110, and then the transport section 7 transports the recording medium P, on which the recording is performed, to the detecting section 4.

Meanwhile, after recording is performed on the recording medium P, the recording data input from the PC 2 is deleted in the recording section 3.

Next, in step S130, the detecting section 4 detects whether or not the recording medium P, on which the recording is performed, has an image defect. Specifically, the recording device 1 of the present embodiment reads an image by using the detecting section 4, and then compares the read data with the record data input from the PC 2 by using a control section (not shown) to determine as to whether or not the recording medium P has an image defect.

If it is determined in step S130 that an image defect is present, the flow proceeds to step S160, and if it is determined in step S130 that an image defect is not present, the flow proceeds to step S190.

After the determination of as to whether or not an image defect is present on the recording medium P is completed, the record data input from the PC 2 is deleted in the detecting section 4.

In step S160, by control of the control section (not shown), correction data is created, and a nozzle having ejection failure in the recording head H of the recording section 3 is restored by the restoring section C. Then, the flow proceeds to step S170.

In step S170, the repair recording section 5 performs repair recording based on the correction data. Then, the flow proceeds to step S190.

In step S190, the recording medium P, for which it is determined in step S130 that an image defect is not present, or the recording medium P, on which repair recording is performed by the repair recording section 5 in step S170, is stored in the main accumulation section 6. Then, the recording method of the present embodiment for the one recording medium P is completed.

According to the recording method of the present embodiment, the repair recording section 5, which is provided separately from the recording section 3, performs repair recording for the image defect detected by the detecting section 4. Therefore, if an image defect occurs when, for example, recording is performed on recording media P successively, the recording section 3 can perform recording even while the repair recording section 5 is repairing the image defect. That is, an image defect in the image recorded on a recording medium P can be repaired efficiently.

Second Embodiment of Recording Method

FIG. 11

Next, a second embodiment of a recording method using the recording device 1 of the abovementioned second embodiment will be explained.

Figure 11:
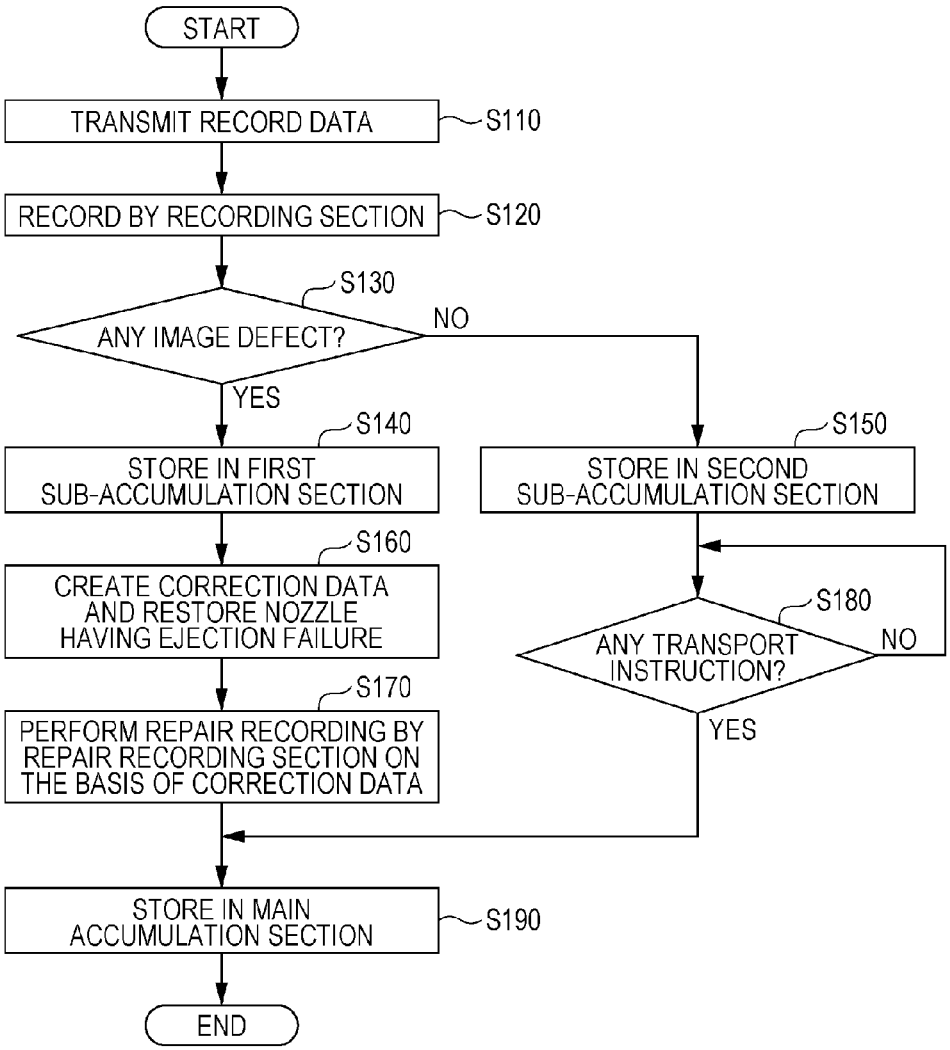
FIG. 11 is a flowchart showing a recording method according to the second embodiment of the invention.

FIG. 11 is a flowchart showing a recording method of the present embodiment, and, as with the recording method of the first embodiment, the recording method corresponds to recording for one recording medium P. Thus, when recording is performed for a plurality of recording media P on the basis of the record data input from the PC 2, the recording method (the recording method for one recording medium P) represented in the flowchart of FIG. 11 is repeated for the number of the recording media P.

Steps S110 to S130 are the same as those of the recording method of the first embodiment, and the descriptions thereof are omitted.

However, in the recording method of the present embodiment, if it is determined in step S130 that an image defect is present, the flow proceeds to step S140, and if it is determined in step S130 that an image defect is not present, the flow proceeds to step S150.

In step S140, a recording medium P, for which it is determined in step S130 that an image defect is present, is temporarily stored in the first sub-accumulation section 11. Then, the recording medium P is transported to the repair recording section 5 while the repair recording section 5 is not performing repair recording, and then the flow proceeds to step S160.

Meanwhile, the subsequent steps S160 to S190 are the same as those of the recording method of the first embodiment, and the descriptions thereof are omitted.

In step S150, a recording medium P, for which it is determined in step S130 that an image defect is not present, is temporarily stored in the second sub-accumulation section 12. Then, in the subsequent step S180, the process waits until the repair recording section 5 transmits to the second sub-accumulation section 12 a transport instruction (instruction signal) for instructing the second sub-accumulation section 12 to transport the recording medium P to the main accumulation section 6, and then the flow proceeds to step S190.

According to the recording method of the present embodiment, in a case where, for example, recording is performed on recording media P successively, a recording medium P having an image defect is temporarily stored in the first sub-accumulation section 11 and a recording medium P having no image defect is temporarily stored in the second sub-accumulation section 12, whereby the recording media P can be stored efficiently in the main accumulation section 6 in the order in which images were recorded on the recording media P.

The entire disclosure of Japanese Patent Application No. 2014-036410, filed Feb. 27, 2014 is expressly incorporated by reference herein.

What is claimed is:

1. A recording device comprising:

a recording section that records an image on a recording medium;

a detecting section that detects an image defect in the image recorded by the recording section;

a repair recording section that is provided separately from the recording section and downstream of the detecting section and that performs repair recording for the image defect detected by the detecting section;

a main accumulation section, wherein images in which the image defect is detected are transported to the main accumulation section by a first transport path and images without the image defect are transported to the main accumulation section by a second transport path; and at least one sub-accumulation section that is provided between the detecting section and the main accumulation section in a transport path of the recording medium and that temporarily stores the recording medium on which an image was recorded by the recording section;

wherein a plurality of the sub-accumulation sections are provided, the sub-accumulation sections are configured as a first sub-accumulation section that temporarily stores a recording medium on which an image defect is detected by the detecting section, and a second sub-accumulation section that temporarily stores a recording medium on which an image defect is not detected by the detecting section.

2. The recording device according to claim 1, wherein the main accumulation section that stores the recording medium on which an image was recorded by the recording section, the recording device further comprising:

a first transport section that transports the recording medium to the main accumulation section or the repair recording section on the basis of a detection result of the detecting section; and a second transport section that transports the recording medium, which has been transported to the repair recording section, to the main accumulation section.

3. The recording device according to claim 1, further comprising:

a restoring section for the recording section, the restoring section being configured to be capable of restoring the recording section while the repair recording section is performing repair recording.

4. The recording device according to claim 1, wherein the first sub-accumulation section and the second sub-accumulation section are arranged so as to be shifted in a vertical direction.

5. A recording method comprising:

recording an image on a recording medium by using a recording section;

detecting an image defect in the image recorded in the recording with a detecting section;

storing the recording medium on which an image was recorded by the recording section, to a main accumulation section;

temporarily storing the recording medium to sub-accumulation sections that are configured as a first sub-accumulation section that temporarily stores a recording medium on which an image defect is detected by the detecting section, and a second sub-accumulation section that temporarily stores a recording medium on which an image defect is not detected by the detecting section; and performing repair recording for the image defect detected by the detecting section using a repair recording section, which is provided separately from the recording section and downstream of the detecting section.

* * * * *